US005944482A

United States Patent [19]

Cronin

[11] Patent Number: 5,944,482

[45] Date of Patent: Aug. 31, 1999

[54] FRONT-REMOVABLE BEARING HOUSING FOR VERTICAL TURBINE PUMP

[75] Inventor: Richard J. Cronin, Westminster, Md.

[73] Assignee: Ingersoll-Dresser Pump Company, Liberty Corner, N.J.

[21] Appl. No.: 08/924,744

[22] Filed: Sep. 5, 1997

[51] Int. Cl.[6] ..... F01D 11/00

[52] U.S. Cl. ..... 415/111; 415/211.2; 415/230; 415/221

[58] Field of Search ..... 415/111, 112, 415/113, 211.2, 229, 230, 219.1, 901, 216.1, 221, 168.3; 384/276, 147; 277/564

[56] References Cited

U.S. PATENT DOCUMENTS

| | | | |
|---|---|---|---|
| 1,392,227 | 9/1921 | Schleyer | 415/112 |
| 3,398,694 | 8/1968 | Lerch | 103/87 |
| 3,620,639 | 11/1971 | Gaffal | 415/111 |
| 3,652,179 | 3/1972 | Hager | 415/111 |
| 4,063,849 | 12/1977 | Modianos | 415/210 |
| 4,305,593 | 12/1981 | Smith | 277/59 |
| 4,417,850 | 11/1983 | Hacker et al. | 415/142 |
| 5,213,468 | 5/1993 | Sexton et al. | 415/111 |
| 5,496,150 | 3/1996 | Claxton et al. | 415/229 |

FOREIGN PATENT DOCUMENTS

| | | | |
|---|---|---|---|
| 0309797 | 12/1988 | Japan | 415/111 |
| 149307 | 11/1960 | U.S.S.R. | 415/111 |

*Primary Examiner*—Edward K. Look
*Assistant Examiner*—Richard Woo
*Attorney, Agent, or Firm*—Robert F. Palermo

[57] ABSTRACT

A bearing housing in a bowl of a vertical turbine pump for a lower bearing of a rotatable pump shaft on which an impeller is mounted includes a separable hollow substantially cylindrical housing body with upper and lower ends, having a radial flange at its lower end adapted for sealing attachment to a bottom face of the bowl such that it is capable of installation in and removal from the bottom face of the bowl, the housing body also having an inside diameter greater than an outside diameter of the shaft to provide a clearance therebetween. A bearing is fixed within the lower end of the housing body for journaling the shaft therein, and provision is made for sealing between the upper end of the housing body and an internal axial bore in the bowl. A seal is also provided between the lower end of the housing body and the shaft for excluding pumped fluid from the clearance. Pumped fluid pressure against the seal, as well as particle size of solids carried by the pumped fluid, is limited by a close clearance between the impeller hub and a restriction bushing mounted in the bearing housing. Flushing with clean fluid may be provided, flow of which fluid being permitted out of the clearance, between the housing and the shaft, through the seal.

18 Claims, 2 Drawing Sheets

FRONT-REMOVABLE BEARING HOUSING FOR VERTICAL TURBINE PUMP

BACKGROUND OF THE INVENTION

This invention relates generally to non-clogging vertical turbine pumps and more particularly to flushable bearing housings which are removable from the suction end of the pump without disassembly of the attached column pipe.

The lower bowl bearing in a vertical turbine pump used for pumping liquids which contain entrained solids is the one most subject to wear and most often in need of replacement. This is because of exposure of the bearing to the abrasive and corrosive effects of the solids-containing pumped fluid which leaks between the pump shaft and the bowl adjacent to the impeller hub and infiltrates between the bearing and the rotating shaft. In some such pumps, a wear ring is pressed into the lower end of the bowl and provides a close clearance around the hub of the impeller to limit the size of particles entering the bearing from the contaminated pumped fluid. It also reduces the total amount of infiltrating fluid. This wear ring also must be replaced when it deteriorates, thereby necessitating extracting the worn ring from the bowl using a special puller and pressing a replacement ring into the bowl.

Commonly, in such pumps, flushing with clean fluid is provided to remove wear particles and abrasive and corrosive material which infiltrates the lower bowl bearing from the pumped fluid. In most cases of bearing failure, only the lower bowl bearing requires replacement. This is attributable to the fact that the lower bearing is closest to the pumped fluid and is exposed to the abrasive and corrosive effects of any infiltration of the pumped fluid into the flushing tube. The bearing serves to further block pumped fluid infiltration up the flushing tube and thereby protects the upper bearings.

Since vertical turbine pumps are commonly assembled from the bottom up, the bearings are pressed into the bowl, the shaft is inserted through the bearings, the impeller is fastened to the shaft, and the suction head is attached to the bowl. The discharge conduit is attached above the bowl, and the motor, electrical, water, and piping connections are made.

To replace the bearings, the connections must be broken in the reverse order as they were made, the bearings removed and replaced, and the assembly repeated. Thus, to gain access to the bearings requires removal of many unrelated parts. This complicates bearing replacement and makes such replacement very time consuming.

Some improvement has been achieved by adapting the bowl assembly to receive a bearing cartridge in which the upper and lower bowl bearings are fitted. This allows bearing changes to be accomplished by merely replacing the bearing cartridge. The replacement of bearings is thereby simplified, but, in some cases, the flow of flushing fluid to the lower bowl bearing may still be inadequate and premature failure of the lower bowl bearing may still occur. Also, wear ring replacement is not addressed in these bearing cartridges.

The foregoing illustrates limitations known to exist in bearings of the bowls of presently available vertical turbine pump designs. It would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a bearing housing, for a fluid-flushed lower bearing in a bowl of a vertical turbine pump having a rotatable shaft on which a hub of an impeller is mounted, the bearing housing comprising a hollow substantially cylindrical housing body with upper and lower ends, separable from said bowl and having a radial flange at its lower end adapted for sealing attachment to a bottom face of said bowl such that said housing body may be installed in and removed from the bottom face of said bowl, said housing body also having an inside diameter greater than an outside diameter of said shaft to provide a clearance therebetween; means for sealing between the upper end of said housing body and an internal axial bore in said bowl; a bearing fixed within the lower end of said housing body for journaling said shaft therein; means for supplying clean flushing fluid through said clearance to a journal interface between said shaft and said bearing; means for sealing between the lower end of said housing body and said shaft for excluding pumped fluid from said clearance; and means for limiting action of pumped fluid on said means for sealing between the lower end of said housing body and said shaft.

The foregoing and other aspects will become apparent from the following detailed description of the invention when considered in conjunction with the accompanying drawings.

DETAILED DESCRIPTION

Figure 1:
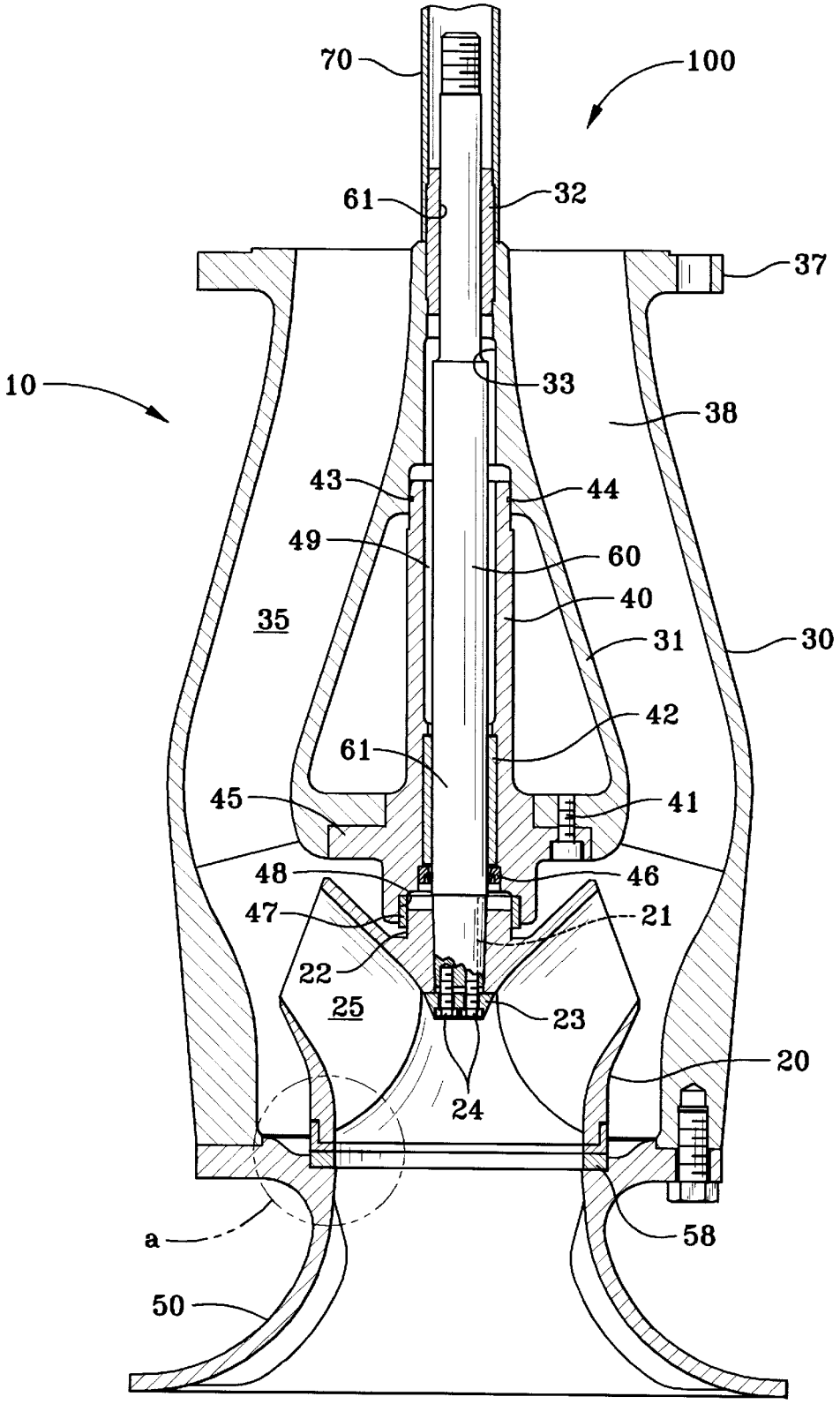
FIG. 1 is a schematic cross-sectional elevation view of a non-clogging vertical turbine pump incorporating a bearing housing according to the invention.

The invention, as applied to a vertical turbine pump, is shown in FIG. 1. The pump 100 comprises a pump bowl case 10 consisting of a bulbous outer shell 30 surrounding a bulbous inner core 31 and separated therefrom by stand-offs 35, which are preferably in the form of substantially axial diffuser vanes which spiral around the core 31. The stand-off distance maintained by the diffuser vanes 35 defines two or more axial diffuser passages 38 between the bulbous core 31 and the bulbous shell 30. A flange 37 at the top of shell 30 permits attachment of a discharge conduit (not shown). A suction bell 50 is attached to the lower end of the bulbous shell 30 to guide working fluid into the impeller 20, where it is pumped by the impeller blades 25 into the axial diffuser passage 38.

The impeller 20 is mounted to a rotatable shaft 60 by fasteners 24 through a retainer 23. A bearing 32 is fixed in the central axial passage 33 of the bowl assembly frame 31, at its juncture with the enclosing tube 70 surrounding the rotatable pump shaft 60, and journals the rotatable shaft 60 in the upper end of the bowl assembly core 31 and the lower end of the enclosing tube 70. Similar bearings may be provided around the shaft at appropriate intervals in very deep installations. In such cases, the bearings may be most conveniently provided at junctions between enclosing tube sections. The shaft may have a hard surface 61 formed by a diffusion heat treatment or by applying coatings of ceramic, hard metal, or composite material in the journaled region to improve durability. The lower end of the rotatable shaft 60, which also may have a hard surface 61, extends through a lower bearing 42 to drivably engage the impeller 20 by means of a key 21 disposed in axial keyways of the impeller 20 and the shaft 60. The lower bearing 42 is mounted in a separable hollow substantially cylindrical bearing housing 40, (illustrated in FIG. 2) which has an inside diameter larger than the outside diameter of the shaft 60 so that an annular axial flushing channel, contiguous with the downstream channel between the shaft 60 and its surrounding enclosing tube 70, is formed around the shaft. This channel carries flushing fluid, preferably from a clean external supply of fluid, to the bearings 32,42 and shaft 60 during operation of the pump 100 to flush away wear particles, debris, and any solids that may migrate from the solids-containing pumped fluid into the bearings. A lip seal 46 is provided between the shaft 60 and the lower end of the bearing housing 40 to prevent such solids migration to the extent that it is possible to do so. This lip seal 46 acts as a check valve which allows downward flow of flushing fluid from the flushing channel 49 into the flushing chamber 29, while preventing flow of pumped fluid in the opposite direction.

Flange 45 at the lower end of the bearing housing 40 is fastened to the lower end of the bowl assembly frame 31 by fasteners 41 which do not require the use of special tools. This provides a seal between the lower ends of the bearing housing 40 and the bowl assembly frame 31. A seal is provided between the upper ends of the housing 40 and frame 31 by an o-ring 44 in a circumferential groove 43 on the upper end of the bearing housing 40. Alternatively, the circumferential groove, with the o-ring, may be provided in the central axial passage 33 of the bowl assembly frame 31, or in both members. Thus, only clear pressurized flushing fluid is permitted into the flushing channel 49, from which it preferably passes through at least one substantially axially disposed groove in the inner journal surface of the bearing 42, past the lip seal 46 and into flush chamber 29 where it causes an elevated pressure to discourage entry of solids-containing working fluid into the flush chamber 29. The lip seal 46 acts as a check valve for flow of clean flushing fluid from the bearings 32, 42 into the flush chamber 29, and from there through the clearance between the restriction bushing 47 and the impeller hub 22. This counter flow through the clearance provides additional protection against entry into the flush chamber 29 of solid particles from the pumped fluid exiting from the impeller discharge.

Figure 2:
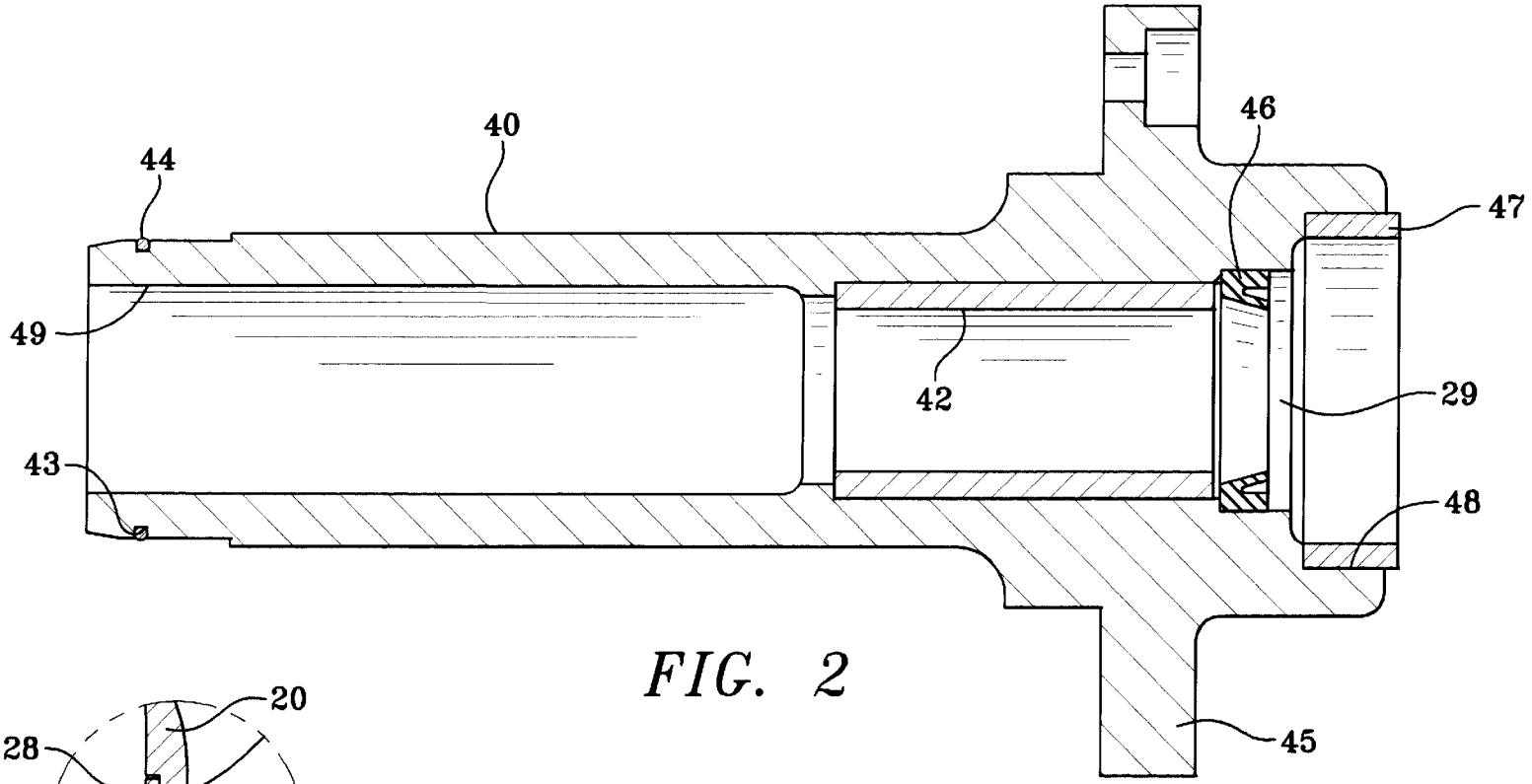
FIG. 2 is a schematic cross-sectional side view showing the bearing housing of the invention.
Figure 1A:
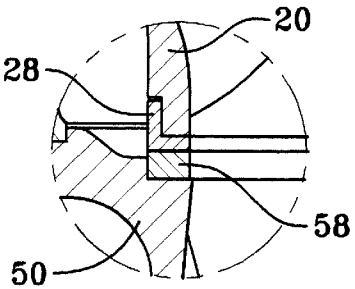
FIG. 1*a* is a detail view of zone "a" of FIG. 1, showing detail of an optional impeller wear ring.

In order to extend life of the seal 46 and bearing 42, as shown in FIG. 2, an extension is provided on the lower end of the bearing housing 40 with a bore 48 which is matched and closely fitted to the hub 22 of the impeller 20 to provide a close clearance between the two surfaces. This would cause a large pressure drop in any infiltrating fluid, even if there were no downward flow of clean flushing fluid, and would discourage such infiltration into the flush chamber 29. When combined with such clean flushing flow, the exclusion of solids-bearing pumped fluid from the flush chamber is even more complete. A restriction bushing 47 may be included to provide a closely fitted replaceable wear surface. A similar matched replaceable wear ring (not shown) could also be applied to the hub 22 to improve the precision of the close clearance together with the restriction bushing 47. FIG. 1*a* shows an optional wear ring 28 that may be mounted on the impeller 20 adjacent to the corresponding ring 58 on the suction bell 50. Use of such wear rings permits refurbishing the impeller and the suction bell by replacing them rather than by replacing the impeller and/or the suction bell.

Note that the close clearance between the bore 48 and the hub 22, together with the seal 46, even without flushing, very significantly reduces damage to the lower bearing 42 by decreasing activity of pumped fluid on the seal (and bearing) due to their effects of limiting pressure of pumped fluid and particle size of solids carried by the pumped fluid to the area behind the impeller. Incorporating flushing, along with these features, almost completely eliminates the effects of the pumped fluid and solids borne thereby. This enhanced effectiveness extends the life of the lower bearing 42. Moreover, when occasional replacement of the bearing 42, the seal 46, and the restriction bushing 47 is required, the operation is greatly simplified by their incorporation in the bearing housing 40.

Having described the invention, I claim:

1. A bearing housing, for a fluid-flushed lower bearing in a bowl of a vertical turbine pump having a rotatable shaft on which a hub of an impeller is mounted, comprising:

a hollow substantially cylindrical housing body surrounding said shaft with upper and lower ends, separable from said bowl and having a radial flange at its lower end adapted for sealing attachment to a bottom face of said bowl such that said housing body may be installed in and removed from the bottom face of said bowl, said housing body also having an inside diameter greater than an outside diameter of said shaft to provide a clearance therebetween;

means for sealing between the upper end of said housing body and an internal axial bore in said bowl;

a bearing fixed within the lower end of said housing body for journaling said shaft therein;

means for supplying clean flushing fluid through said clearance to a journal interface between said shaft and said bearing;

means for sealing between the lower end of said housing body and said shaft for excluding pumped fluid from said clearance; and means for limiting pressure of pumped fluid and particle size of solids carried by said pumped fluid against said means for sealing between the lower end of said housing body and said shaft.

2. The bearing housing of claim 1, wherein the means for sealing between the upper end of said housing body and an internal axial bore in said bowl comprises a circumferential groove on the outside surface of said housing body for retaining an o-ring; and an o-ring disposed within said groove for bearing against the axial bore of said bowl.

3. The bearing housing of claim 1, wherein the means for supplying clean flushing fluid through said clearance to a journal interface between said shaft and said bearing comprises a tube connected to a supply of clean flushing fluid, said tube surrounding said shaft to form an annular axial passage along said shaft, said tube conducting flushing fluid through said passage and into axially disposed grooves on the journal surface of said bearing.

4. The bearing housing of claim 1, wherein the means for sealing between the lower end of said housing body and said shaft for excluding pumped fluid from said clearance comprises a lip seal member mounted within said housing body and bearing against said shaft, said lip seal member functioning as a check valve for permitting flow of flushing fluid into a flushing chamber situated between said lip seal member and said hub on a back shroud of said impeller, but preventing flow of fluid in the opposite direction.

5. The bearing housing of claim 1, wherein the means for limiting pressure of pumped fluid against said means for sealing between the lower end of said housing body and said shaft comprises an extension on the lower end of said housing body adjacent a flushing chamber, said extension having an axial bore with a close radial clearance around the hub of the impeller to limit pressure of pumped fluid flowing through said clearance and for limiting particle size of solids carried by said pumped fluid.

6. The bearing housing of claim 5, further comprising:

a restriction bushing fitted to at least one of said bore, at the lower end of said housing body, and an outer surface of said impeller hub to provide a close radial clearance between said housing body and said impeller hub.

7. The bearing housing of claim 1, wherein the means for limiting pressure of pumped fluid against said means for sealing between the lower end of said housing body and said shaft comprises a restriction bushing fitted within a bore at the lower end of said housing body and providing a close radial clearance around the hub of the impeller.

8. The bearing housing of claim 1, wherein the means for sealing between the lower end of said housing body and said shaft for excluding pumped fluid from said clearance comprises a seal member mounted within said housing body and bearing against said shaft for preventing flow of pumped fluid into said clearance.

9. A bowl assembly for a vertical turbine pump with an impeller mounted on a rotatable shaft, comprising:

a bowl case having an outer bulbous shell supported on stand-offs on an inner bulbous frame to define an annular axial diffuser passage therebetween, said inner bulbous frame having a central axial passage;

a separable hollow substantially cylindrical bearing housing body with upper and lower ends, said housing body being installed in and removed from a bottom end of the central axial passage of the inner bulbous frame, and having a radial flange at its lower end adapted for sealing attachment to a bottom face of said inner bulbous frame, said bearing housing body also having an inside diameter greater than an outside diameter of said shaft to provide a clearance for passage of clean flushing fluid therebetween;

means for sealing between the upper end of said bearing housing body and the central axial passage in said inner bulbous frame;

a bearing fixed within the lower end of said housing body for journaling said shaft therein;

means for sealing between the lower end of said bearing housing body and said shaft for excluding pumped fluid from said clearance; and means for limiting pressure of pumped fluid and particle size of solids carried by said pumped fluid against said means for sealing between the lower end of said bearing housing body and said shaft.

10. The bowl assembly of claim 9, wherein at least one of said stand-offs on said inner bulbous frame comprises a stationary diffuser vane.

11. The bowl assembly of claim 9, wherein the means for sealing between the upper end of said housing body and the central axial passage in said inner bulbous frame comprises a circumferential groove on the outside surface of said housing body for retaining an o-ring; and an o-ring disposed within said groove for bearing against an axial bore in the central axial passage of said inner bulbous frame.

12. The bowl assembly of claim 9, wherein the means for sealing between the lower end of said bearing housing body and said shaft for excluding pumped fluid from said clearance comprises a seal member mounted within said housing body and bearing against said shaft.

13. The bowl assembly of claim 9, wherein the means for limiting pressure of pumped fluid and particle size of solids carried by said pumped fluid against said means for sealing between the lower end of said bearing housing body and said shaft comprises an extension on the lower end of said housing body, said extension having an axial bore with a close radial clearance around the hub of the impeller.

14. The bowl assembly of claim 9, wherein the means for limiting pressure of pumped fluid and particle size of solids carried by said pumped fluid against said means for sealing between the lower end of said bearing housing body and said shaft comprises a restriction bushing fitted within a bore at the lower end of said housing body and providing a close radial clearance around a hub of the impeller.

15. In a vertical turbine pump of the type having a bowl assembly with an annular axial diffuser passage communicating with a discharge end of an impeller mounted on a rotatably driven shaft, a central axial passage in said bowl assembly surrounding said rotatably driven shaft, a suction bell mounted to an upstream end of said bowl assembly, and a discharge conduit downstream of said bowl assembly, the improvement to said bowl assembly comprising:

a separable bearing housing disposed within said central axial passage and supporting a lower bearing for journaling said rotatably driven shaft, said bearing housing including:

a hollow substantially cylindrical housing body with upper and lower ends disposed in said central axial passage and having a radial flange at its lower end adapted for sealing attachment to a bottom face of said bowl about said central axial passage, said housing body being capable of installation in and removal from said bottom face of said bowl and also having an inside diameter greater than an outside diameter of said shaft to provide a fluid clearance for passage of clean flushing fluid therebetween;

means for sealing between the upper end of said housing body and said central axial passage in said bowl assembly;

a bearing fixed within the lower end of said housing body for journaling said shaft therein;

means for sealing between the lower end of said housing body and said shaft for excluding pumped fluid from said fluid clearance; and means for limiting pressure of pumped fluid and particle size of solids carried by said pumped fluid against said means for sealing between the lower end of said housing body and said shaft.

16. The improvement of claim 15, further comprising:

at least one diffuser vane substantially axially disposed within said annular axial diffuser passage.

17. The improvement of claim 15, further comprising:

means for flushing said bearing by passing fluid through said fluid clearance to a contact interface between said bearing and said shaft to flush debris from said contact interface.

18. The improvement of claim 17, wherein the means for flushing said bearing by passing fluid through said fluid clearance to a contact interface between said bearing and said shaft comprises at least one substantially axially disposed groove on the inside contact surface of said bearing.

* * * * *